US005197731A

United States Patent [19]

Svoma et al.

[11] Patent Number: 5,197,731

[45] Date of Patent: * Mar. 30, 1993

[54] STRING SUSPENSION AND FRAME CONSTRUCTION FOR SPORTS RACKETS

[76] Inventors: Rodney Svoma; James Speros, both of 1210 E. Northern, Phoenix, Ariz. 85020; Gene A. Broadman, 4051 East Ave., Livermore, Calif. 94550

[ * ] Notice: The portion of the term of this patent subsequent to Aug. 6, 2008 has been disclaimed.

[21] Appl. No.: 740,336

[22] Filed: Aug. 5, 1991

Related U.S. Application Data

[63] Continuation of Ser. No. 233,228, Aug. 18, 1988, Pat. No. 5,037,097.

[51] Int. Cl.[5] ..... A63B 51/06

[52] U.S. Cl. ..... 273/73 C; 273/73 R; 273/73 D

[58] Field of Search ..... 273/73 R, 73 C, 73 D

[56] References Cited

U.S. PATENT DOCUMENTS

| | | | |
|---|---|---|---|
| 4,119,313 | 10/1978 | Popplewell et al. | 273/73 C X |
| 4,365,806 | 12/1982 | Reid et al. | 273/73 C |
| 4,802,678 | 2/1989 | Svoma | 273/73 C X |
| 5,037,097 | 8/1991 | Svoma et al. | 273/73 D X |

*Primary Examiner*—Theatrice Brown
*Assistant Examiner*—Raleigh W. Chiu
*Attorney, Agent, or Firm*—Berthold K. J. Weis

[57] ABSTRACT

A sports racket having a stringed playing surface wherein selected ends of individual string segments meet the frame alternately in front of or behind the plane of the playing surface.

7 Claims, 9 Drawing Sheets

STRING SUSPENSION AND FRAME CONSTRUCTION FOR SPORTS RACKETS

CROSS REFERENCE TO RELATED APPLICATIONS

This application is continuation of our co-pending application Ser. No. 07/233,228 entitled "Improved Sports Racket", Filed Aug. 18, 1988, by the same inventors now U.S. Pat. No. 5,037,097.

FIELD OF INVENTION

This invention generally relates to sports rackets, such as rackets for the games of tennis, racket ball, squash, badminton, or the like, which are comprised of a webbed netting strung from a frame, and more particularly to stringing configurations, frames comprised of multiple joined pieces, and combinations thereof.

BACKGROUND OF THE INVENTION

The highly competitive modern game of tennis places ever increasing demands on performance characteristics of rackets. An important aspect relates to racket strength or stiffness versus weight. Modern materials are typically fiber reinforced thermoplastic or thermosetting resins, and lightweight metals or their alloys. In order to save weight with minimum sacrifice in strength, it has long been recognized that it is desirable to provide rackets of hollow, or tubular construction.

The manufacturing problems posed in producing curved hollow structures are exemplified in a paper entitled "Volume Production with Carbon Fibre Reinforced Thermoplastics", R. C. Haines, Plastics and Rubber Processing Application, Vol. 5, No. 1, 1985, which describes the production method for producing a top-of-the-line tennis racket by Dunlop International Sports Company. To produce a hollow frame an injection molding process is used which employs a removable core. A eutectic metal core of a melting point lower than that of thermoplastic resin, is accurately positioned in a mold to ensure uniform wall thickness. Chopped fiber loaded thermoplastic is then injected into the space between the core and the die, and the core is thereafter removed by heating. It should be readily appreciated that such a process is complicated and poses many difficulties.

Other inventions have provided hollow frame configurations which are formed by the assembly and joinder of two or more structural components which define a hollow space in the frame, for example, U.S. Pat. Nos. 4,194,738 and 4,836,543. However, these approaches rely upon the joinder of dissimilar pieces along a curvilinear joint around the racket head. All of these designs present difficulties both from the point of view of mold design and subsequent assembly.

OBJECTS OF THE INVENTION

It is therefore a principal object of the invention to provide a racket frame configuration comprised of component pieces which can be readily and economically manufactured and assembled.

Another object of the invention is to provide a hollow racket which can be made from compression molded parts.

Yet another object of the invention is to provide a racket frame of superior mechanical and dynamic response properties.

Still another object of the invention is to provide a racket frame construction which complements the splayed string suspension system of the present invention and that of the parent case.

Another object of the invention is to provide a string suspension system in which the string segments are largely anchored to the racket frame out of the center plane, thus permitting the racket frame to be joined in the central plane.

Yet another object of the invention is to provide a frame-string suspension combination, where the strings contribute to the mechanical integrity of the frame.

Still another object of the invention is to provide a handle-grip system which can be easily fitted and assembled at retail outlets.

A further object of the invention is to provide a handle-grip combination where the grip contributes to the integrity of the frame assembly.

These and other objects of the invention will become apparent to those skilled in the art upon consideration of the following description, drawings and claims.

SUMMARY OF THE INVENTION

The above and other objects of the invention are achieved by providing a sports racket having the following major aspects:

A first aspect relates to a frame which comprises at least two pieces which are joined together along a plane substantially parallel to the playing surface, particularly including rackets comprised of frame half sections joined together in a plane coincident with the central plane through the playing surface of the racket. It will be readily apparent that this construction permits the formation of a racket frame having hollow interiors and, moreover, by appropriate selection of a stringing arrangement, may be made from identical halves.

This racket construction envisions the use of a wide variety of materials, including fiber reinforced thermosetting or thermoplastic resins, including Kevlar, fiberglass, carbon, boron fiber and the like, embedded in matrix materials such as epoxy, nylon, polyethylene, polypropylene, polycarbonate and the like. The racket construction of this invention can, of course, also be employed with metals such as steel, aluminum, magnesium, titanium, beryllium and their suitable high-strength lightweight alloys, and is particularly intended for use with ceramic and cermet materials in view of the particular difficulties which these materials present in forming hollow structures.

The two half racket pieces are readily joined by a variety of per se known methods of joining materials, i.e., press fitting keyed parts, adhesive bonding, welding, brazing and the like, as appropriate for the materials employed.

Regardless of the choice of material, an important advantage of the present invention is that it permits parts to be made using simple open-faced molds, dies, or casts which offer the frame designer wide latitude in improving the mechanical characteristics of frames.

For example, while such parts may be made by injection molding of chopped fiber loaded resins, it is possible to compression mold the half rackets with continuous fiber lay-ups with the fibers oriented in predetermined directions to counteract torsion as well as deformation of the racket frame.

Another advantage is that it is possible to include ribs in the hollow interior with the purpose of strengthening the racket to counteract deformation in the plane of the stringing in response to hitting balls hard. Another feature and advantage of such rackets composed of two halves joined along the central plane is that it permits the introduction of gaskets of particular materials for the purpose of modifying mechanical and dynamic response, such as materials of more resilient and/or stiffer characteristics such as for modal dampening, i.e., the suppression of specific modes of vibration. Such gaskets may also include materials for fine tuning the weight distribution of the racket frame, e.g., by employing layers or foils of a heavy metal, e.g., lead, with varying size apertures to produce the desired weight distribution for achieving an intended response of the racket.

A second major aspect relates to the stringing system which lead to and makes the present racket frame construction possible. Our previously filed application referenced above discusses such systems of stringing rackets extensively and its disclosure in expressly incorporated herein by reference. U.S. Pat. No. 4,802,678 entitled "Sports Racket" issued on Feb. 7, 1989 to Rodney Svoma, also a co-inventor in this case, relates to the present stringing systems as well. The key characteristic of such stringing arrangements is that they exhibit substantial "splay", i.e., all or at least a substantial number of the string ends extending from nodes formed from intersecting longitudinal and lateral string segments nearest to the periphery of the frame and at the outer boundary of the interwoven ball contact surface are alternately secured to the frame in front of and behind the central plane of the racket. In the context of this invention, by "forming a node" we mean that the direction of the string end leading from the point of contact with the intersecting string to the frame is sufficiently changed to prevent the intersecting string to move towards the frame. In other words, if the racket is placed with its face horizontal, the strings whose ends are secured to the frame above the central plane pass under the first intersecting string, and vice versa.

It is preferred that the ends extending from the nodes near the corners of the woven surface, to the sections of the frame between the lateral sections and the tip or heel sections, be secured to the frame at minimal distances from the central plane. These distances may be zero, where the bond between the two halves of the frame are sufficiently strong to not be deleteriously affected. Alternatively, the half frames may be configured so that the joint between them is stepped out of the central racket plane near these corners. While it is preferred that the splay near these corners exhibits minima, it is to be understood that these minima may be non-zero, and thus compatible with the frame construction without modifying the mating surface in the areas involved.

It is preferred that the splay be maximal where the lateral strings meet the frame in the region where the frame is the broadest and where the central longitudinal strings meet the head and the heel of the frame. To accommodate enhanced splay it is preferred that the width of the frame be enhanced, at least in the portions of the sides of the frame where the splay is the greatest, it being generally desirable that the splay is a direct function of the distance of the node to the frame.

The present racket's throat may be formed from an integral part of the half frames, or it may be an insert to be fitted to the racket during final assembly. The string ends may contact the throat in the plane of the racket or they may be splayed. Where the throat is an integral part of the racket frame, the mating surfaces may be stepped in front of and/or behind the central plane of the racket, where zero splay is desired and where perforations through the joint are undesirable.

While the splayed stringing arrangement plays a major role in prompting and facilitating the above discussed frame construction, it also permits alternate frame modifications. For example, the splay in the strings makes a V-shaped volume between the splayed ends available for a frame with an enhanced cross-sectional breadth in the central plane of the racket. This allows construction of a frame which has greater strength aganist deformation in the plane of the racket compared to racket designs of equal cross-sectional area.

Another frame modification comprises a central hoop within an outer frame whose integrity is augmented by the splayed string suspension system and the handle-grip system.

Another aspect of the invention relates to the handle. The invention envisions providing suppliers with a wider assortment of sizes or styles for improved fitting for players according to hand size and preference. In the simplest execution of the concept the grip comprises a tubular sleeve, which fits a cylindrical handle of matching cross-sections. A desired grip may be attached by means of adhesive supplied with the racket. For a more sophisticated version the handle portion of the frame is terminated with a keyed recess which fittingly engages projections of all handles. A chosen handle is then inserted in the keyed recess and secured to the handle by bolting and/or adhesive. The keyed recess and projections are configured to permit insertion of the handle with the correct orientation only. Preferably the joint between the racket and the handle includes a resilient member such as hard rubber which prevents the transmission of vibrations from the racket to the player. In a preferred version, the hard rubber member may be axially compressed and radially expanded to form a tight joint with the handle and the grip.

BRIEF DESCRIPTION OF THE DRAWINGS

Embodiments of the invention will be described in detail with reference to the following drawings, in which

FIGS. 9*a*, 9*b*, 9*c* and 9*d* show alternate frames.

DETAILED DESCRIPTION OF THE PREFERRED EMBODIMENT

The Frame

Figure 1:
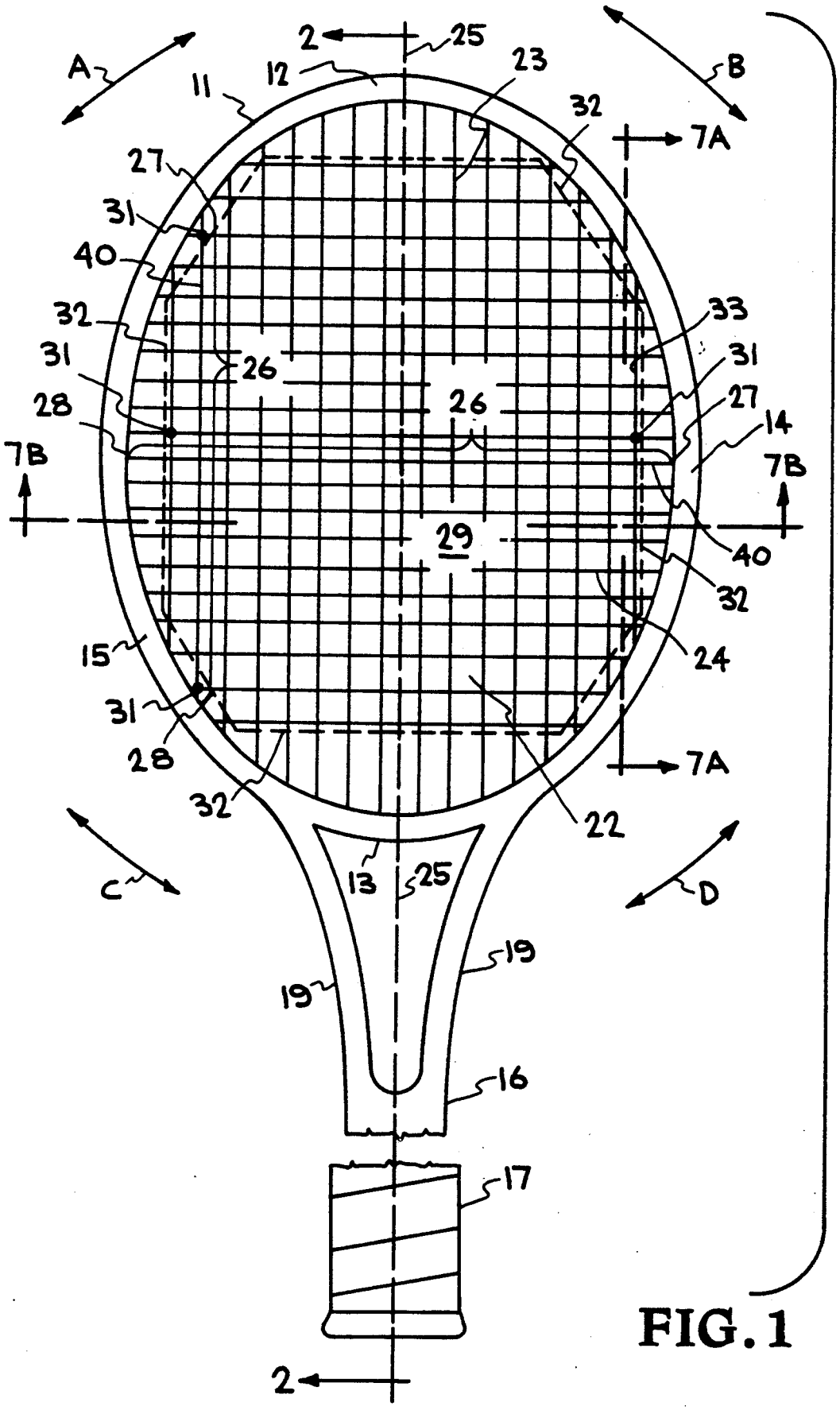
FIG. 1 is a plane view of a conventional racket according to the present invention.

FIG. 1 is a plan view of a tennis racket comprising a frame 11 having a conventional oval portion comprising tip and heel portions 12 and 13, respectively, and lateral sections 14 and 15, respectively, which define the stringing surface. Handle 16 with hand grips 17 extend from the heel portion of the frame and are secured to the heel by arms 19. While the drawings shows a racket of the conventional elliptical type it should be recognized that the playing surface and frame could have alternate plane geometries.

Figure 2A:
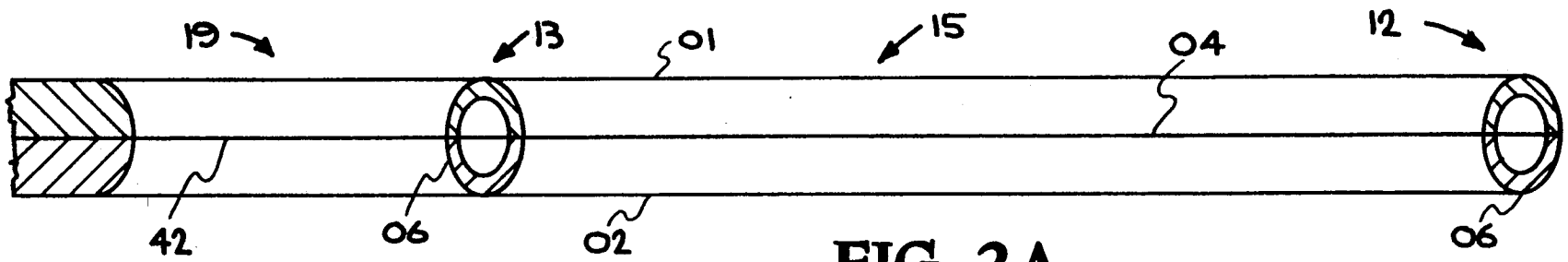
FIGS. 2*a*, 2*b* and 2*c* are longitudinal cross-sections of the frame of the present racket.
Figure 2B:
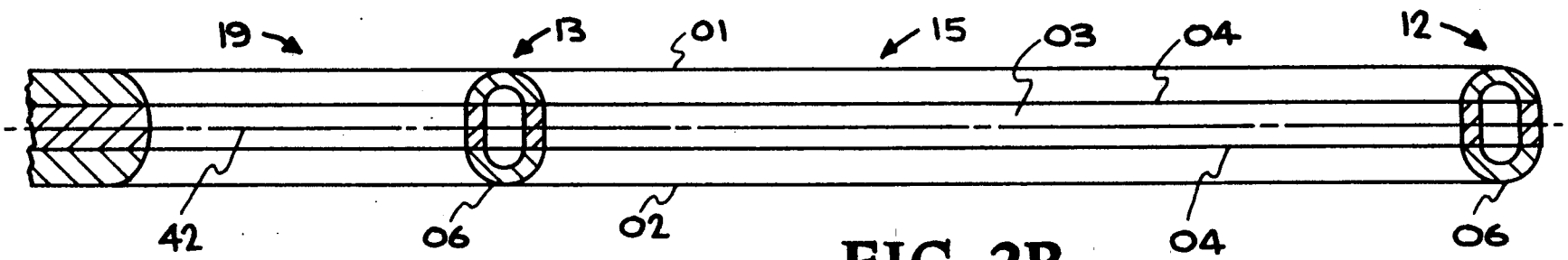
Figure 2C:
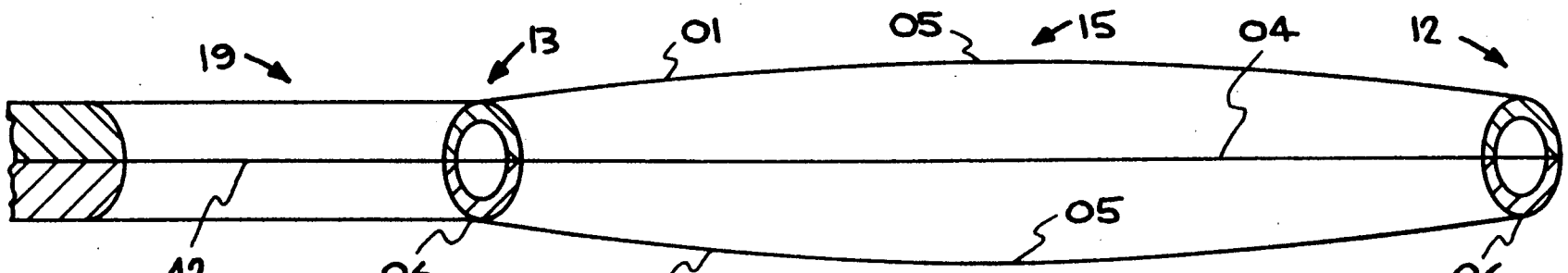

FIGS. 2*a*, 2*b* and 2*c* are cross-sectional views of the racket frame without showing the handle and stringing, which will be discussed in greater detail below.

In these figures the numeral 42 refers to the center plane through the racket, i.e., the plane through the playing surface, 12 to the tip, 15 to the lateral portion, 13 the throat, and 19 the arms of the racket frame. The entire frame is comprised of an upper half frame 01, a lower half frame 02, joined together along seam 04, which lies in the center plane of the racket. The throat and tip portions of the frame are shown in cross-section. In FIG. 2*b* the entire frame is composed of three pieces, top and bottom portions 01 and 02, and a central portion 03, all having mating surfaces substantially parallel to the central plane of the racket. The preferred frames are an entirely hollow construction as depicted in the cross-sections 06 shown for the throat and the tip. Needless to say the entire frame or portions of it could also be solid throughout. FIG. 2*c* shows a frame wherein the lateral section has been widened to accommodate enhanced splay in the region where the playing surface has the greatest lateral dimension as indicated by the numeral 05.

The cross-sectional shape of the frame portions as shown are elliptical, but other cross-section shapes could be employed, such as essentially square, rectangular, circular, etc. The choice is largely a matter of the mechanical properties associated with a particular cross-section, such as moments, section modulus etc.

As discussed above, the concept of making racket frames by joining half frames along the central racket plane is applicable to a wide variety of materials, including metals, ceramics and cermets. An important materials subclass for constructing racket frames in accordance with this invention are the fiber reinforced plastics. Examples of metals are lightweight high strength steels, aluminum, magnesium, beryllium, titanium and their alloys. A desirable cermet is Al-$B_4C$.

There are many known methods for manufacturing racket halves for each of the above enumerated materials. They include forging, stamping, machining, casting, die casting, or extrusion for metals and alloys; hot isostatic pressing and firing, and combustion synthesis for ceramics; metal infiltration of ceramic bodies; and combustion synthesis for cermets, for example.

Again, an important subclass relates to the manufacture of fiber reinforced materials. The half frames may be made by injection molding, vacuum forming, or especially compression molding of chopped fiber reinforced composites. It is particularly envisioned to manufacture racket halves by impregnating continuous fiber or fiber matte, where the fibers are laid up in optimal directions to maximize desirable mechanical properties and response characteristics. For example, as will be discussed in greater detail below, it is particularly envisioned to employ the present racket frames with the splayed string suspension system. Since with this stringing arrangement the strings are secured to the frame out of the center plane, when a ball hits the strings, the impact forces will generate torsional force components, particularly on the side portions of the racket frame. An optimal fiber layup therefore provides a helical arrangement of fibers in the side portions of the racket frame to take up these force components.

Figure 3A:
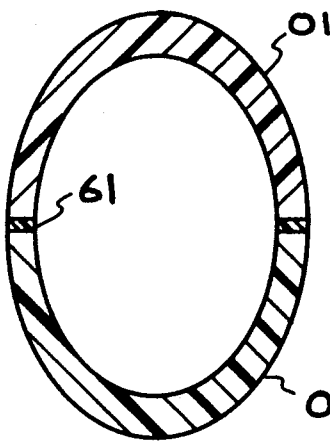
FIGS. 3*a* to 3*g* show cross-sections of lateral portions of various frame modifications.
Figure 3B:
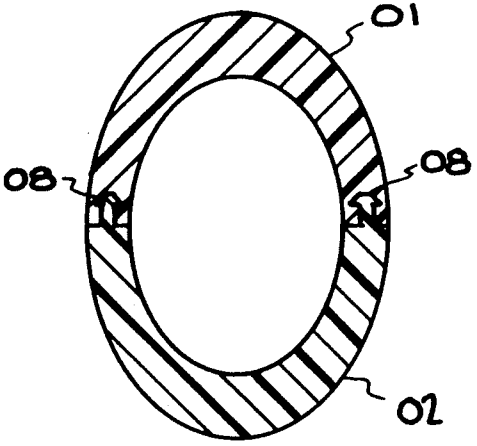

The two half frames may be joined along the mating surfaces by a variety of methods. On approach to joint formation applicable to any material is by means of adhesive bonding. Metals and alloys may be joined by brazing, vacuum brazing, welding, electron beam welding, arc welding and the like. FIGS. 3*a* to 3*g* show cross-sections of various modifications of the joints between mating surfaces. FIG. 3*a*, adhesive or bonding layer 61, joins together flush mating surfaces of upper and lower section 01 and 02, respectively. Fiber reinforced composites may be joined as shown in FIG. 3*b* by press fitting half frames provided with a joint 08 of interlocking ridges and recesses, which may be combined with adhesive bonding.

Figure 3C:
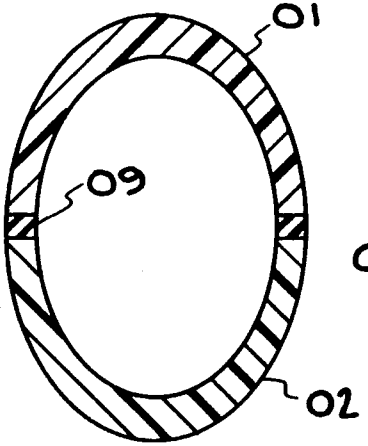
Figure 3D:
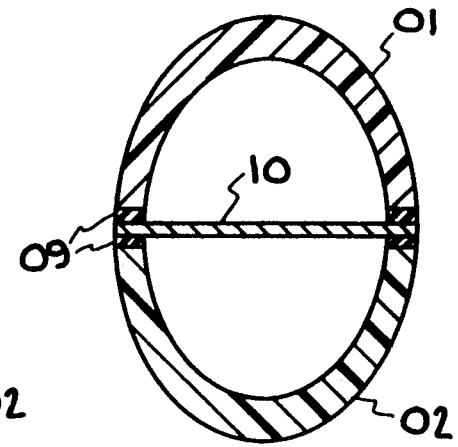

The mating surfaces may be bonded together in direct contact with each other, or to one or more intervening layers 09 of gasket materials as shown in FIGS. 3*c* and 3*d*. FIG. 3*c* shows the two half frames, respectively, bonded to opposite sides of layer 09 of resilient material, such as rubber, polyurethane foam, soft polyethylene, or the like. FIG. 3*d* shows the half frames bonded to a sandwich gasket comprising resilient material bonded to a bridge material 10. The bridge material may be enhance stiffness and/or weight. The advantages imparted by resilient materials are general and modal dampening. The advantages of incorporating the stiff material such as steel is that the racket has increased stiffness and resistance against flexture and deformation in the plane of the racket. The advantage of heavy materials, such as lead foil, is to achieve a desired weight distribution. Variation of weight can be achieved by perforations or cutouts of varying area.

Figure 3E:
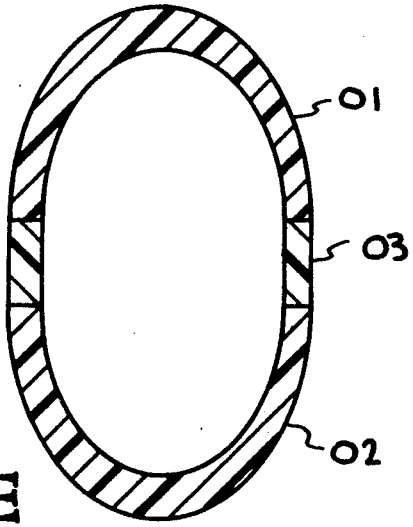
Figure 3F:
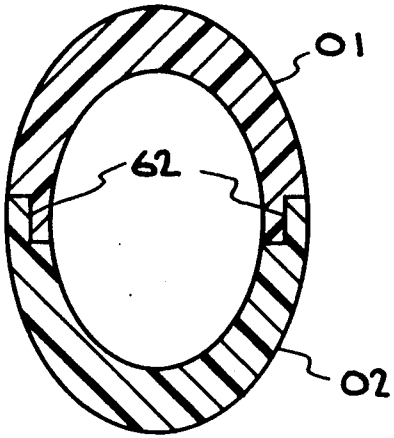
Figure 3G:
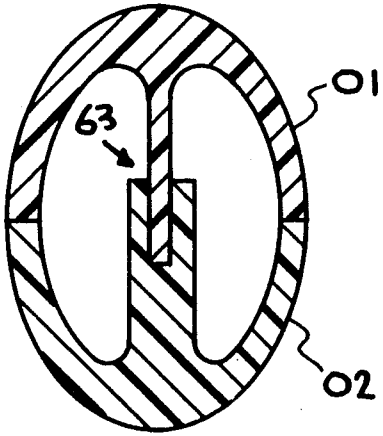

FIG. 3*f* shows a male-female type of joint 62 which is secured by means of adhesive. FIG. 3*g* shows a variation of post and pin joint 63, which may be used to strengthen the assembly perpendicular to the plane of the racket through the post, and laterally as a result of the pinning.

Figure 4A:
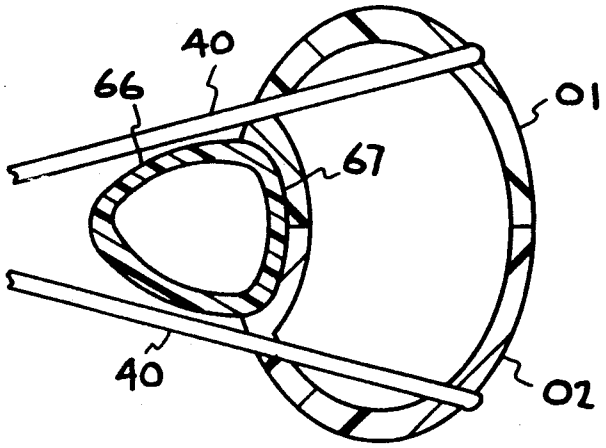
FIGS. 4*a* and 4*b* show a frame modification reinforced with an inner hoop.
Figure 4:
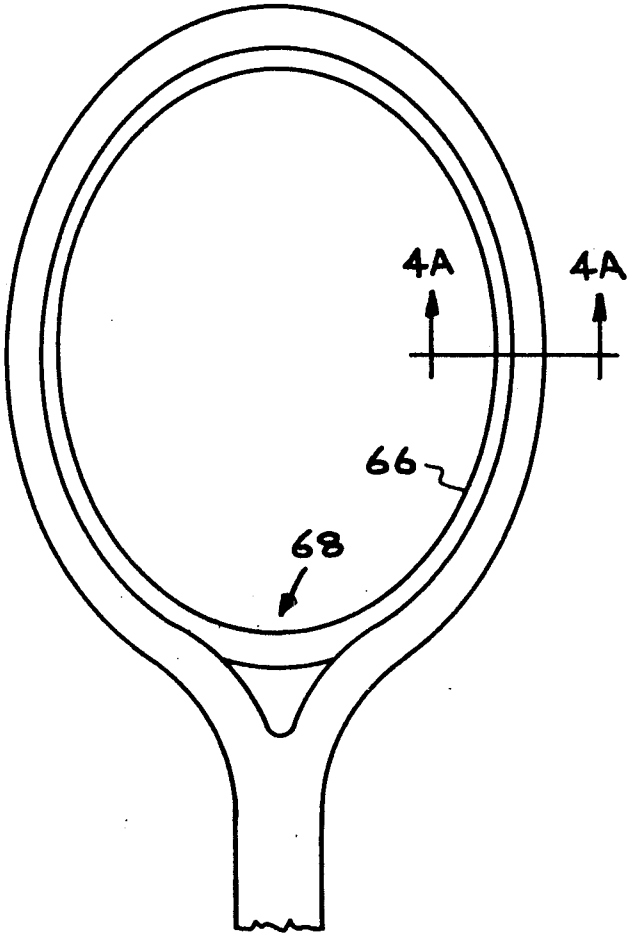

FIG. 3*e* shows a cross-section of a racket assembled from three pieces. Such racket frames could be particularly useful for conventional string suspension systems where the strings are anchored in the center plane, and where the drillings for the string holes would unduly weaken the joint FIGS. 4 and 4*a* show an alternate variation of racket stiffening against deformation in the racket plane, which comprises, in addition to the two half frames 01 and 02, an internal hoop 66 which may be press fit into recess 67 formed by the two half frames around the interior of the frame. Alternatively, the interior hoop may be installed in the course of the assembly of the racket halves. The hoop may also be used to provide the throat piece 68. The configuration shown in FIGS. 4 and 4*a* are particularly suitable for use in rackets having a string arrangement with splay large enough for the string ends to clear the hoop all the way around the racket. This arrangement takes advantage of the fact that the splay of the strings makes space available for the hoop. At the throat the longitudinal strings may also be anchored to the hoop in the plane of the racket.

Figure 5:
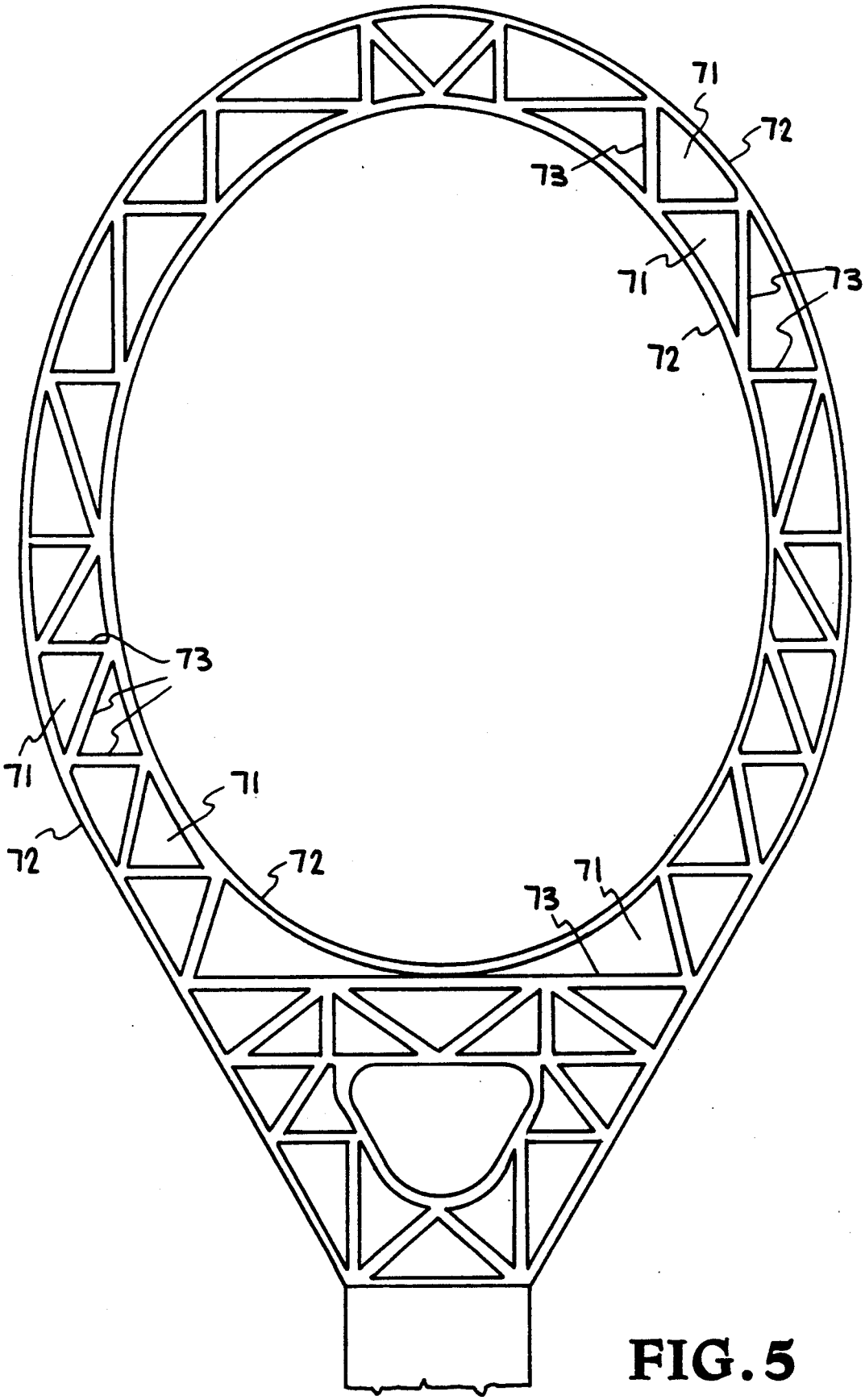
FIG. 5 shows an exemplary ribbed interior construction.

FIG. 5 is a plan view of one half frame. The interior hollow spaces 71 defined by outer frame walls 72 are criss-crossed by ribs 73 whose function it is to counteract deformation of the individual racket frame portions as well as deformation of the racket frame in its entirety. The hollow spaces 71 of any of the embodiments could be filled with any of a variety of lightweight high strength polymeric foams, such as polyurethane foam.

Figure 6:
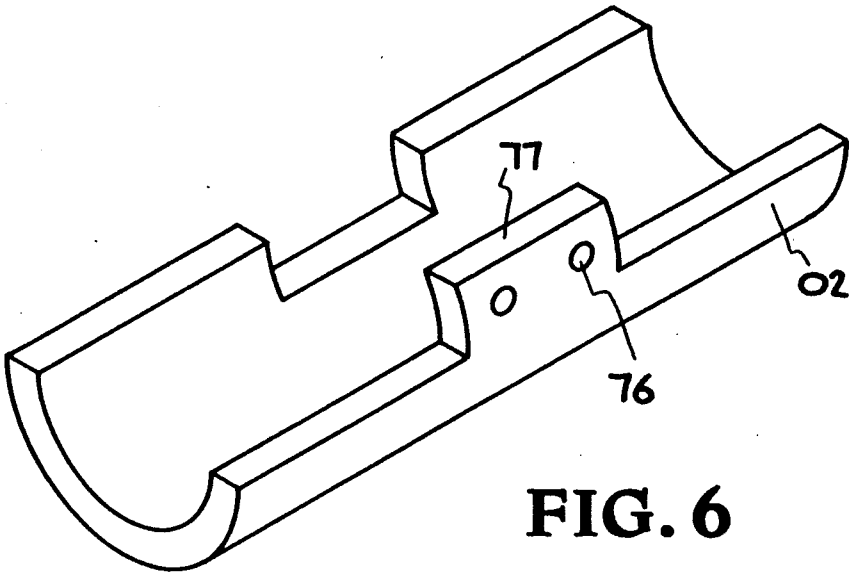
FIG. 6 is a detail view of a stepped mating surface to accommodate string systems where $d_i=0$.

FIG. 6 shows a detail of a stepped mating surface arrangement in frame section 02 to accommodate stringing arrangements wherein some of the strings are secured to the racket frame in the plane of the playing surface, i.e., $d_i \approx 0$, and where it is undesirable to drill the string holes 76 through the joint between the upper and lower mating halves. Steps 77 provide material for accommodating the string holes in the desired locations. Recess 78 receives the corresponding stepped surface of the mating fraction section 01 (not shown).

Racket frames according to this invention, i.e., assembled by joinder of two or more racket components with facing surfaces parallel to the central plane of the racket could be used with conventional stringing arrangements, particularly the variations shown in FIG. 3*e*. They are, of course, especially intended to be used in combination with "splayed" stringing arrangements as discussed below.

The Stringing

Figure 7A:
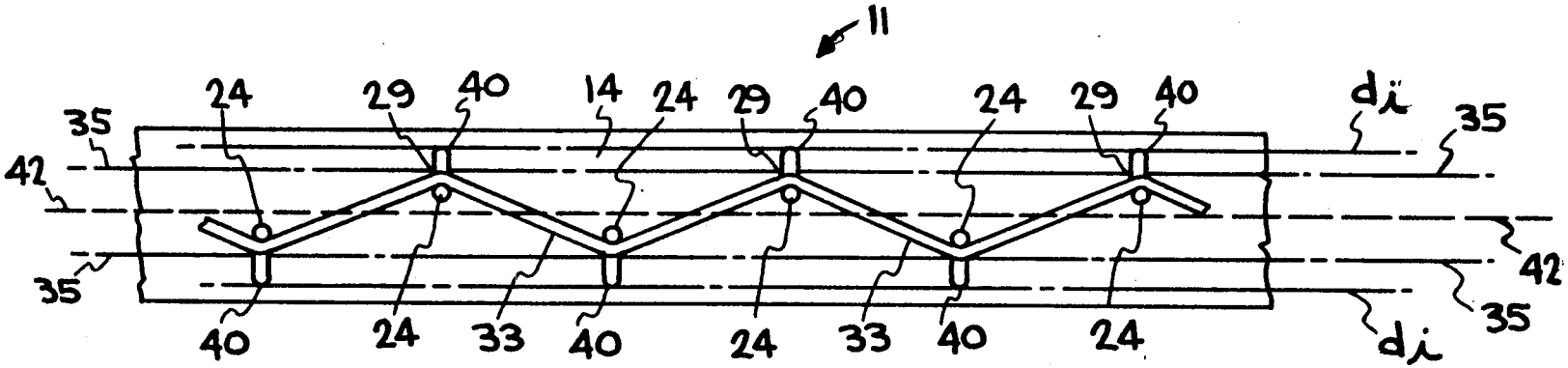
FIGS. 7*a* and 7*b* show a cross-section through the webbing illustrating the splayed configuration of the ends extending from nodes to the frame.
Figure 7B:
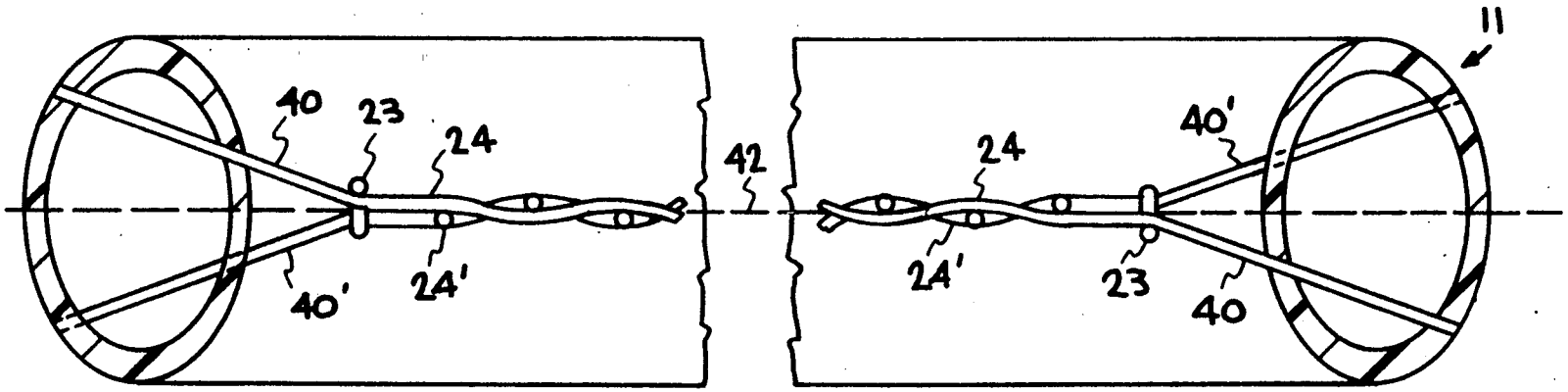
Figure 8:
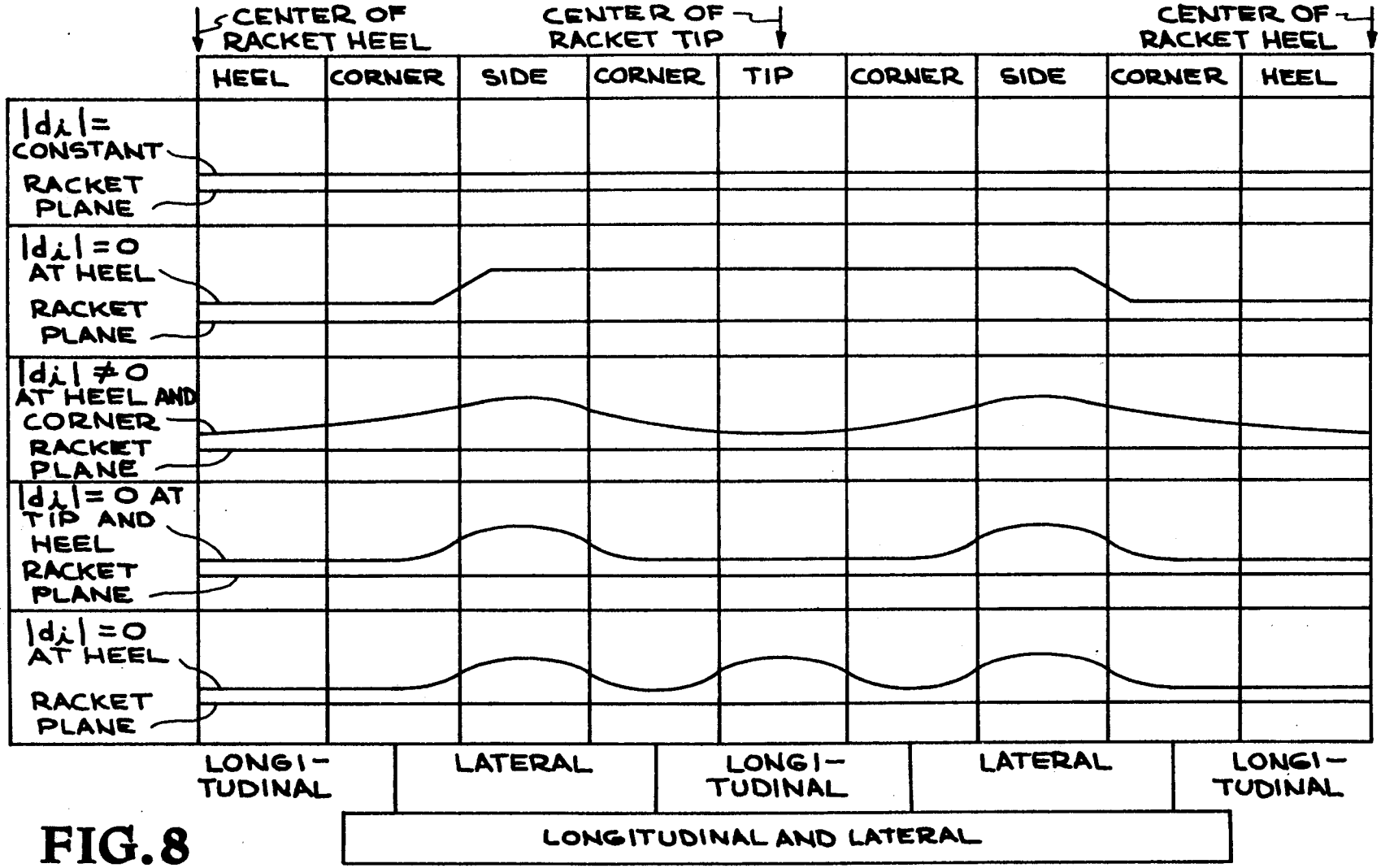
FIGS. 8*a*, 8*b* and 8*c* show the relation of $|d_i|$ vs. frame location for various radiant modifications.

With reference to FIGS. 1, 7 and 8, it may be seen that the frame is strung with a planar webbing 22 of interwoven strings, comprising longitudinal strings 23 and lateral strings 24. In the conventional fashion the longitudinal strings run parallel to the racket axis 25 and the lateral strings perpendicular to it, but again the concepts of this invention are equally applicable to stringing arrangements where the string segments are strung in other directions and intersect at other than right angles, say diagonal string arrangements, for example. Continuing to use the terminology established in the parent application, the part of the string between opposed point of contact locations 27 and 28 on the frame are called string segments 26, and the intersection or contact points of any lateral and longitudinal string nearest the adjacent frame are called nodes 31. The piece of the lateral and/or longitudinal string between a node and the point at which the string contacts or is secured to the frame is called a string segment end 40, or simply an end. The interwoven planar central area 29 within dotted line 32 toward the center of the racket from the nodes is considered the playing or ball contact surface.

The significant feature of the stringing arrangement is that at least a substantial number of the string ends are splayed, i.e., the ends are secured to the frame at distances $d_i$ alternately in front of and behind the central plane of the racket. The quantity $d_i$ denotes the measure of the distance of the contact point from the central plane (positive or negative) and i refers to the order of a particular end in an arbitrary consecutive sequence of ends.

The concept of nodes and splay is important and is best seen in FIGS. 7*a* and 7*b*. In order to ensure that the stringing arrangement achieves the desired three-dimensional spring quality, where there is splay, the end 40 needs to be secured to the frame 11 at a location opposite to the side at which the string end contacts the intersecting string segment, the longitudinal string segment 33 nearest the frame, in order to apply tension to the segment, and at the same time restrain the intersecting string segment from evading the load by displacement toward the frame. When the string end is not secured to the frame in this fashion, for the purposes of this invention, a node has not been formed. The intersecting string 33 is pulled into a zig-zag configuration by the tension applied by string ends 40 anchored to the frame 11 opposite the point of contact as shown in FIG. 7*a*. FIG. 7*b* is an orthogonal view of the node 29 and the splay of ends 40.

FIG. 8 illustrates various distributions of the absolute value of $d_i$, or $|d_i|$, for various racket modifications. The absolute value of $d_i$ is indicated on the y axis, the location on the periphery of the frame is plotted on the x axis, the center of the tip of the racket being in the center of the diagram.

The first plot on top relates to a simple variation wherein $|d_i|$ is a constant all the way around the racket, i.e., the splay is equal for all strings. The second plot shows a stringing configuration, wherein there is splay everywhere except at the throat of the racket. These stringing configurations are best suited for frames employing hoop stabilization as shown in FIG. 4 and FIG. 10.

While the above $|d_i|$ profiles are possible stringing configurations it should be noted that in rackets with the typical oval or ellipsoidal racket face the string ends are not of equal length. For example, in the regions of the tip and heel and the sides where the longitudinal and transverse dimensions of the racket face are greatest, the ends are also the longest. In the transition regions between tip and sides, and the heel and the sides, or the corner regions of the weave labeled A, B, C, or D in FIG. 1, the ends are the shortest. From the point of view of the behavior of the ball contact surface of the weave it is therefore desirable that the splay, or $|d_i|$ exhibit maxima in the regions where the ends and the string segments are the longest, and minima for the corner regions. Another reason for minimal $|d_i|$ in these corner regions is to facilitate the stringing of the racket. The length of the ends can be influenced by the arrangement and location of the drill holes. It is desirable to arrange, by placement and distribution of the inner holes, the location of the longitudinal and lateral strings such that the nodes in these corner regions are at a sufficient distance from the frame to provide ends of reasonable length, permitting $|d_i|$ to be minimal and not zero. It should be noted that the maxima and minima need not be identical, and all or some of the minima may be non-zero.

The $|d_i|$ distributions in the third, fourth and fifth rows are preferred. They are characterized by maximal $|d_i|$ in the regions at or near the center of the sides and minimal $|d_i|$ in the center regions of tip and throat. The profile of $|d_i|$ may vary continuously from a maximum in the center regions at the sides to the zero or non-zero minima at the corner or tip regions. The rate of variation is best a function directly proportional to string segment length, or the length of the ends, but both abrupt and gradual changes in $d_i$ are intended to be included, as are broad maxima and/or minima where $d_i$ is constant for a number of adjacent string ends.

The fifth variation is similar to the variation discussed above, except that the $|d_i|$ profile exhibits a maximum in the center region of the tip as well. As discussed in the parent application, an important attribute of splay in the lateral regions of the racket relates to the correction of the trajectories of off-center hits during normal splay. Splay in the tip region offers players a slightly different and preferred angle of attack for overhead plays and serves, in addition to improved behavior of the stringed playing surface of the racket.

Alternative Frames

A conspicuous feature of the splayed string arrangement is that it makes available space adjacent to the string ends. The hoop arrangement discussed above in connection with FIG. 4 takes advantage of this space to stiffen the racket against deformation in the plane of the playing surface.

Figure 9B:
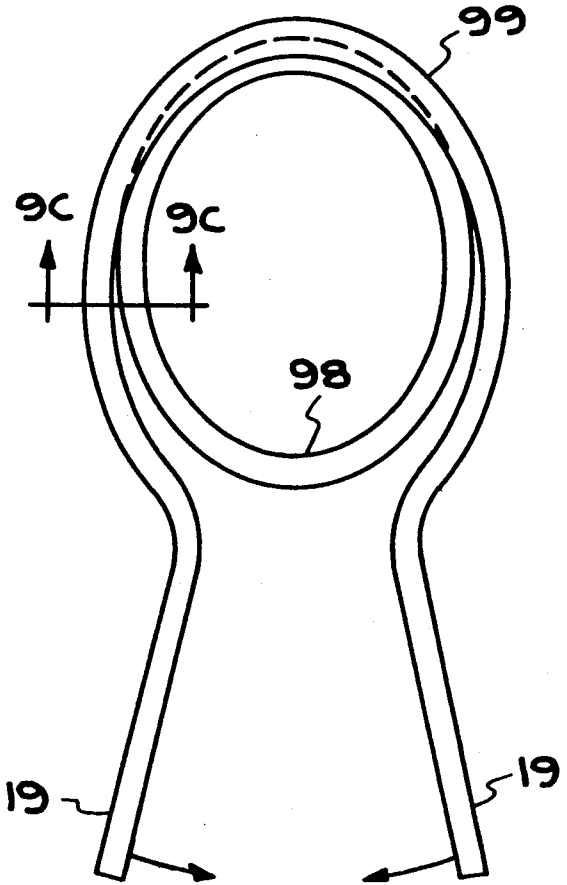
Figure 9A:
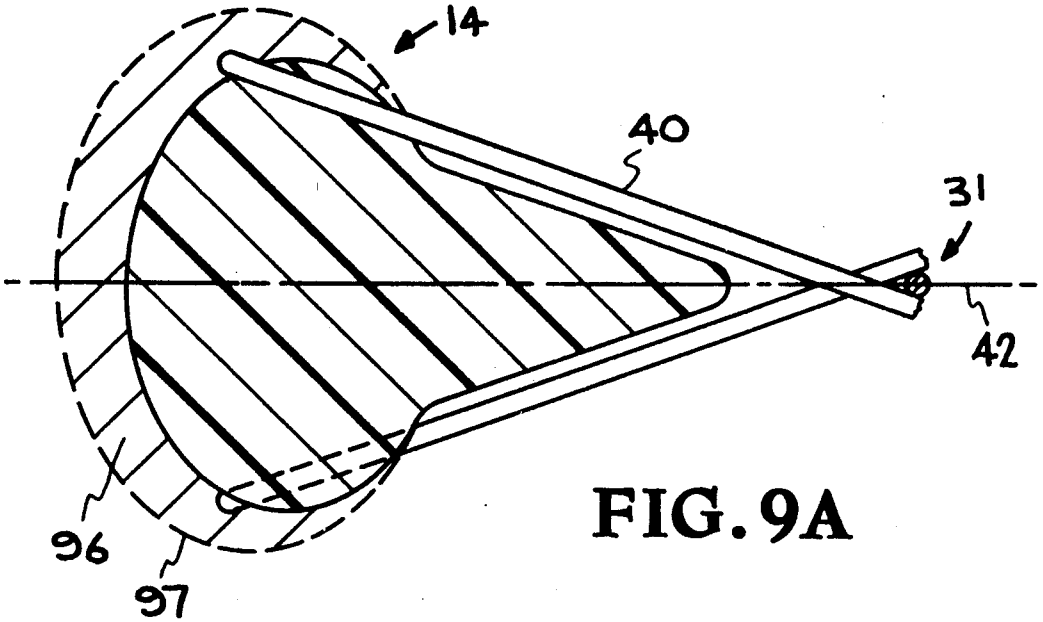
Figure 9C:
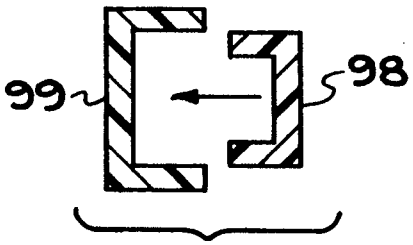

FIG. 9*a* shows a cross-section of a solid racket frame having enhanced dimension in the racket plane 42. Dotted line 97 indicates an outline of a conventional racket, and the crosshatched area 96 essentially represents material redistribution and savings.

The Handle

Sports rackets having frames and stringing arrangements as described above may, of course, be outfitted with conventional handles and grips. The proper sizing and type of grips is an important element in a player's selection of sports rackets. The present rackets being relatively sophisticated means that a supplier would have to make a substantial investment in an inventory of rackets, in order to be prepared to accommodate the needs and preferences of customers regarding grips. Grips being far less expensive than rackets, it is intended to provide rackets and grips separately, so as to permit assembly at the supplier's place of business and reduce the value of inventory necessary to be kept on hand. The simplest version may be a tubular sleeve which fits over the terminal end of the handle, where it may be glued in place by the supplier.

Figure 10B:
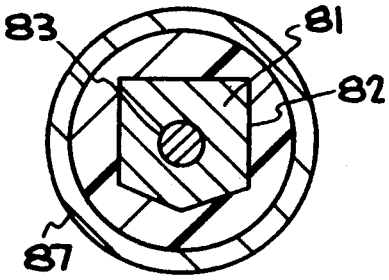
FIGS. 10*a* and 10*b* show the handle assembly in cross-section.
Figure 10D:
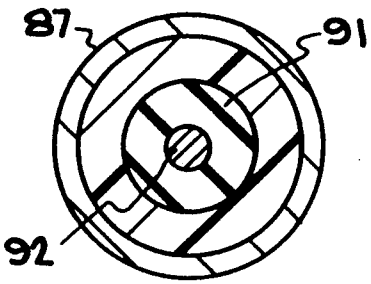
Figure 10C:
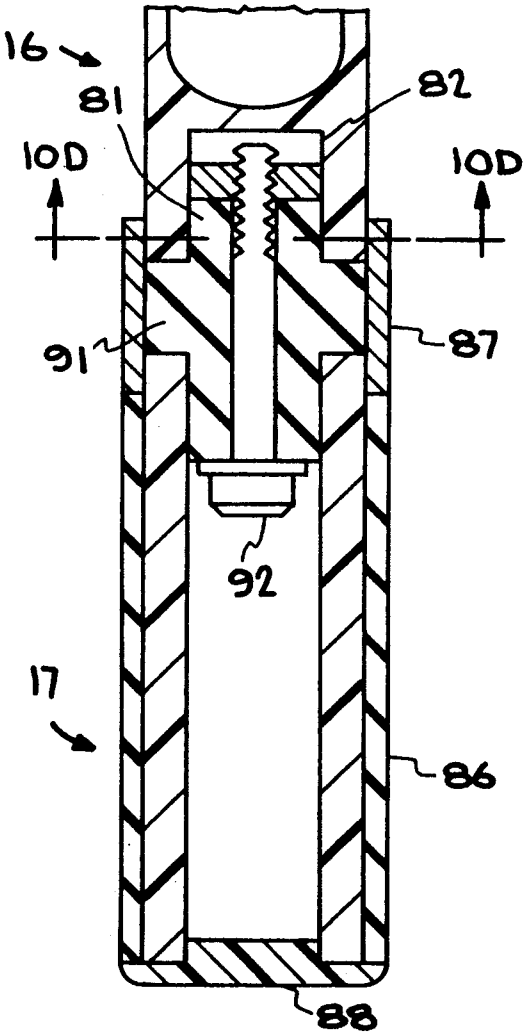
Figure 10A:
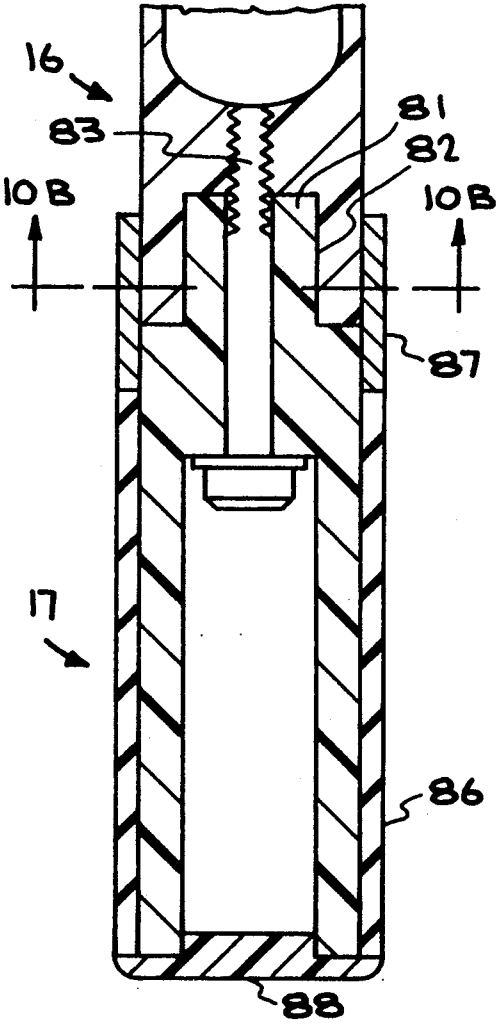

FIGS. 10*a*, 10*b* and 10*c* illustrate preferred racket handle and grip configurations longitudinal and transverse cross-section. With reference to these figures, the numeral 16 refers to the handle portion of the frame, and numeral 17 refers to the grip, which may terminate in a protrusion 81 which fits the recess 82 in one orientation only. Handle and grip of this variation are bolted together. Bolt 83 can be inserted and tightened rapidly at the premises of the supplier by means of conventional tools through access channel 84. The body of the grip is surrounded with covering 86. Grips of different sizes and coverings can be made available for fitting a racket. Collar 87 and access channel cover 88 are readily pressed in place for finish.

Shown in FIG. 10*c* is a preferred version with resilient transition elements 91, made of a material such as hard rubber. Handle and grip are securely fastened together by means of through-bolt 92 which axially compresses and laterally expands the hard rubber element to securely engage both handle and grip. Grip and handle are readily separated by loosening the bolt, rendering the grip removable and interchangeable. A major purpose is to reduce the transmission of shock and vibration from the racket to the player. In addition to bolting, the assembly may be joined by means of adhesive, however grips would then no longer be interchangeable.

Having thus described the invention, it will be apparent to those skilled in the art that numerous variations may be made without departing from the spirit and scope of the invention, which should therefore be limited only by the following claims.

We claim:

1. In a sports racket having a peripheral frame defining a center plane, a handle, and a first and second plurality of string segments extending in a first and second direction between opposed locations on said frame and interwoven to define a ball contact area in said center (central) plane of said racket, the improvement comprising:

that at least a part of said (strings) string segments are interwoven to form nodes near said peripheral frame, and that the ends of string segments leading from said nodes to said frame are splayed to alternately contact said frame in front of and behind said center plane.

2. The improvement of claim 1, wherein all of said strings are interwoven to form nodes and all of said string segments ends contact said frame alternately in front of and behind said plane.

3. The improvement of claim 1, wherein said first plurality of strings extends parallel to the longitudinal axis of said frame and the second plurality of strings perpendicular to said axis, and wherein said first and second plurality of strings are interwoven to form nodes near the sides of said frame and where said ends are splayed to a greater degree in the regions where the length of said ends is greater.

4. The improvement of claim 3, wherein in addition said first plurality of strings is splayed at the tip of said frame and where said ends are splayed to a greater degree near the center of the tip of said frame than in the region between the tip and the sides of the frame.

5. The improvement of claim 4, wherein the degree of splay at and near the heel and between the sides and tip is minimal.

6. The sports racket of claim 3 wherein the splay of said ends (are splayed proportionally to) is a function of the lengths of said ends.

7. The sports racket of claim 1, wherein said peripheral frame comprises a hoop member, a portion of which projects into the space between said ends.

* * * * *

US005197731B1

REEXAMINATION CERTIFICATE (3646th)

United States Patent [19] [11] B1 5,197,731

Svoma et al. [45] Certificate Issued *Oct. 13, 1998

[54] STRING SUSPENSION AND FRAME CONSTRUCTION FOR SPORTS RACKETS

[75] Inventors: Rodney Svoma; James Speros, both of Phoenix, Ariz.; Gene A. Broadman, Livermore, Calif.

[73] Assignee: Athletic Alternatives, Inc., Phoenix, Ariz.

Reexamination Request:
No. 90/004,388, Sep. 27, 1996

Reexamination Certificate for:

| | |
|---|---|
| Patent No.: | **5,197,731** |
| Issued: | **Mar. 30, 1993** |
| Appl. No.: | **740,336** |
| Filed: | **Aug. 5, 1991** |

[ * ] Notice: The portion of the term of this patent subsequent to Aug. 6, 2008, has been disclaimed.

Related U.S. Application Data

[63] Continuation-in-part of Ser. No. 233,228, Aug. 18, 1988, Pat. No. 5,037,097.

[51] Int. Cl.[6] ..... A63B 51/06

[52] U.S. Cl. ..... 473/542

[58] Field of Search ..... 473/537, 540, 473/542

[56] References Cited

FOREIGN PATENT DOCUMENTS 2276845 1/1976 France .
223151 10/1924 United Kingdom .

OTHER PUBLICATIONS

The Stringer's Digest–1987, pp. 6, 10 and 12.

*Primary Examiner*—Raleigh Chiu

[57] ABSTRACT

A sports racket having a stringed playing surface wherein selected ends of individual string segments meet the frame alternately in front of or behind the plane of the playing surface.

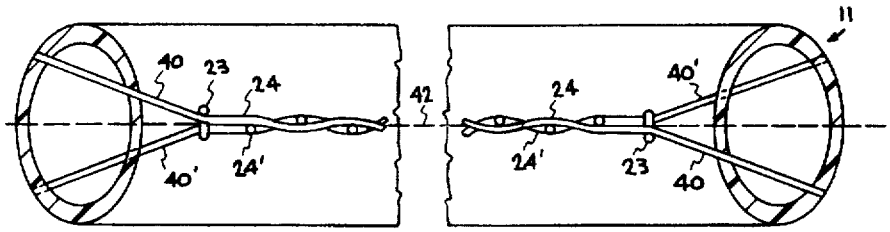

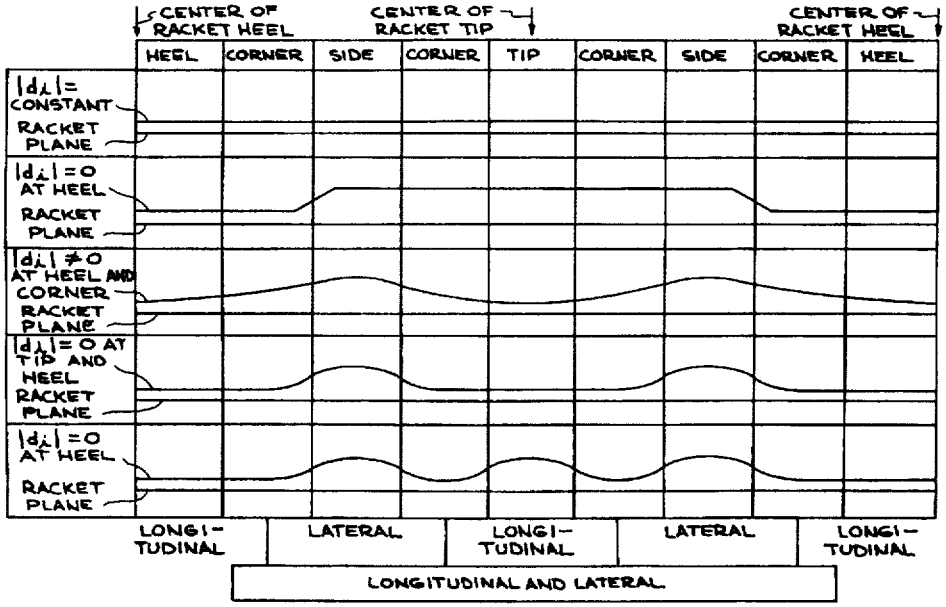

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1–3 are determined to be patentable as amended.

Claims 4–7, dependent on an amended claim, are determined to be patentable.

New claims 8 and 9 are added and determined to be patentable.

1. In a sports racket having a peripheral frame *with inner and outer portions and* defining a center plane, a handle, and [a] first and second pluralit[y]*ies* of string segments extending in [a] first and second directions between opposed locations on said frame and interwoven to define a ball contact area in said center [(central)] plane of said racket, *said first plurality of string segments including a pair of outside string segments disposed respectively adjacent a pair of said opposed locations on said frame,* the improvement comprising:

[that] at least [a part] *one* of said [(strings)] string segments [are] *of said second plurality being* interwoven *with said outside string segments of said first plurality* to form *a pair of* nodes [near] *respectively adjacent said pair of opposed locations on* said [peripheral] frame,

[and that the ends of] *said at least one* string segment[s] *having opposite ends* leading from said nodes to said frame [are] *and being* splayed [to alternately] *in opposite directions away from said center plane such that one of said oppsosite ends* contacts *said inner portion of* said frame in front of *said center plane* and *the other of said opposite ends contacts said inner portion of said frame* behind said center plane.

2. The improvement of claim 1, wherein all of said string[s] *segments* are interwoven to form nodes and all *of said ends* of said string segments [ends] contact *said inner portion of* said frame alternately in front of and behind said *center* plane.

3. [The improvement of claim 1.] *In a sports racket having a peripheral frame defining a center plane, a handle, and a first and second plurality of string segments extending in a first and second direction between opposed locations on said frame and interwoven to define a ball contact area in said center plane of said racket, the improvement comprising:*

*that at least a part of said string segments are interwoven to form nodes near said peripheral frame, and that the ends of string segments leading from said nodes to said frame are splayed to alternately contact said frame in front of and behind said center plane,* wherein said first plurality of string[s] *segments* extends parallel to the longitudinal axis of said frame and the second plurality of string[s] *segments* perpendicular to said axis, and wherein said first and second plurality of string[s] *segments* are interwoven to form nodes near the sides of said frame and where said ends are splayed to a greater degree in the regions where the length of said ends is greater.

*8. The improvement of claim 1, wherein*

*at least two of said string segments of said second plurality are interwoven with said outside string segments of said first plurality to form a plurality of pairs of nodes disposed respectively adjacent said pair of opposed locations on said frame, the distance of splay for one of said at least two string segments being greater than the distance of splay for the other of said at least two string segments.*

*9. The improvement of claim 1, wherein*

*several adjacent ones of said string segments of said second plurality are interwoven with said outside string segments of said first plurality to form a plurality of pairs of nodes disposed respectively adjacent said pair of opposed locations on said frame,*

*each of said several adjacent string segments having opposite ends leading from said respective pair of nodes to said frame and being splayed in opposite directions away from said center plane such that corresponding ends of said several adjacent string segments contact said inner portion of said frame alternately in front of and behind said center plane.*

* * * * *